US009194624B2

(12) United States Patent
Kim et al.

(10) Patent No.: US 9,194,624 B2
(45) Date of Patent: Nov. 24, 2015

(54) DEVICE AND METHOD FOR DRYING FILM

(71) Applicant: SAMSUNG DISPLAY CO., LTD., Yongin, Gyeonggi-Do (KR)

(72) Inventors: Kyu-Bum Kim, Yongin (KR); Jae-Seok Park, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 187 days.

(21) Appl. No.: 13/952,533

(22) Filed: Jul. 26, 2013

(65) Prior Publication Data

US 2014/0308871 A1 Oct. 16, 2014

(30) Foreign Application Priority Data

Apr. 16, 2013 (KR) ..... 10-2013-0041832

(51) Int. Cl.

| | |
|---|---|
| ***F26B 21/00*** | (2006.01) |
| ***F26B 3/30*** | (2006.01) |
| ***F26B 9/06*** | (2006.01) |
| ***F26B 25/00*** | (2006.01) |

(52) U.S. Cl.

CPC ... *F26B 3/30* (2013.01); *F26B 9/06* (2013.01); *F26B 25/003* (2013.01); *F26B 2200/00* (2013.01)

(58) Field of Classification Search

CPC ..... F26B 3/00; F26B 5/00; F26B 19/00; F26B 21/00; F26B 21/06; H01J 9/00; H01J 9/205; G02F 1/00; G02F 1/1335

USPC ..... 34/201, 218, 236, 381; 445/66, 70; 349/106, 110, 187

See application file for complete search history.

(56) References Cited

U.S. PATENT DOCUMENTS

| | | | | |
|---|---|---|---|---|
| 2007/0085228 | A1 | 4/2007 | Nagashima | |
| 2008/0063809 | A1* | 3/2008 | Lee et al. | 427/558 |
| 2009/0287300 | A1* | 11/2009 | Dave et al. | 623/1.42 |
| 2010/0236691 | A1* | 9/2010 | Yamazaki | 156/67 |
| 2011/0116975 | A1* | 5/2011 | Persinger et al. | 422/108 |
| 2012/0036733 | A1* | 2/2012 | Dehn | 34/282 |
| 2013/0316113 | A1* | 11/2013 | Engelhard | 428/40.3 |
| 2014/0308871 | A1* | 10/2014 | Kim et al. | 445/70 |

FOREIGN PATENT DOCUMENTS

| | | | |
|---|---|---|---|
| KR | 10-2008-0058396 | A | 6/2008 |
| KR | 10-2011-0058105 | A | 6/2011 |
| KR | 10-2012-0023975 | A | 3/2012 |
| KR | 10-2012-0096101 | A | 8/2012 |
| WO | WO 2011/080980 | A1 | 7/2011 |

* cited by examiner

*Primary Examiner* — Stephen M Gravini

(74) *Attorney, Agent, or Firm* — Christie, Parker & Hale, LLP

(57) ABSTRACT

A film drying device includes a chamber, a film fixing unit in the chamber and configured to fix a film, and a heater in the chamber and configured to apply heat to the film.

24 Claims, 5 Drawing Sheets

DEVICE AND METHOD FOR DRYING FILM

CROSS-REFERENCE TO RELATED APPLICATION

This application claims priority to and the benefit of Korean Patent Application No. 10-2013-0041832, filed on Apr. 16, 2013, in the Korean Intellectual Property Office, the entire disclosure of which is incorporated herein by reference.

BACKGROUND

1. Field

Aspects of embodiments of the present invention relate to a device and method, and more particularly, to a device and method for drying a film.

2. Description of the Related Art

Mobile or portable electronic equipment is widely used. Mobile electronic equipment includes small electronic devices such as mobile phones, and recently, tablet personal computers (PCs), which are widely used. Such mobile electronic equipment includes a display unit to provide a user with visual information such as an image in order to support various functions. Recently, as other parts for driving the display unit become smaller, the importance of the display unit in the electronic equipment is increasing and a structure that may be bent (e.g., that is flexible) to have a given angle (or curve) is also being developed.

Various types of such a display unit may be formed. In this case, a film may be used as a component of the display unit according to a manufacturing process or according to an operating environment after manufacturing. For example, in the process of manufacturing the display unit, it is possible to use various types of film in order to simplify the manufacturing process and to shorten a manufacturing time. In this case, if the film contains an impurity or if an impurity settles on the surface of the film, there may be a decrease in quality of the display unit.

SUMMARY

Embodiments of the present invention provide a device and method for drying a film, which may dry the film quickly and effectively.

According to an aspect of the present invention, a film drying device includes a chamber; a film fixing unit in the chamber and configured to fix a film; and a heater in the chamber and configured to apply heat to the film.

The chamber may be configured to selectively maintain a vacuum state.

The film fixing unit may include a first clamp; and a second clamp connected pivotably to at least one of the chamber and the first clamp, wherein the second clamp may be configured to be selectively coupled to the first clamp to confine the film.

The film fixing unit may further include a body unit mounted movably on the first clamp.

The body unit may have an opening.

The film fixing unit may further include a tension maintaining unit on at least one of the body unit and the first clamp.

The tension maintaining unit may include a first magnetic unit on the body unit; and a second magnetic unit on the first clamp and configured to generate a repulsive force oriented to repel the first magnetic unit.

The heater may be configured to emit a far infrared ray.

The heater may include a first plate; a heating wire in the first plate; and a second plate on the first plate.

The first plate may include aluminum.

The second plate may be configured to generate a far infrared ray.

The second plate may include a ceramic material.

The heater may include a plurality of regions, and temperatures of each of the plurality of regions of the heater may be configured to be controlled independently of one another.

The film drying device may further include a plurality of heaters and a plurality of the film fixing units, and the heaters and the film fixing units may be alternately arranged.

The film drying device may further include a film temperature measuring unit on the film on one of the plurality of film fixing units, the film temperature measuring unit being configured to measure a temperature of the film.

An operation of at least one of the plurality of heaters may be regulated in accordance with the temperature of the film measured by the film temperature measuring unit.

The film drying device may further include a reflective unit configured to reflect the heat emitted from the heater.

The reflective unit may include a first reflective plate; and a second reflective plate pivotably connected to the first reflective plate.

The reflective unit may further include a rotation angle regulating unit coupling the reflective plate to the second reflective plate and configured to control an angle between the second reflective plate and the first reflective plate.

According to another aspect of the present invention, there is provided a film drying method including feeding a plurality of films into a vacuum chamber and then operating each of a plurality of heaters at a temperature; measuring a surface temperature of a film using a film temperature measuring unit coupled to one of the plurality of films; and controlling an operation of at least one of a reflective plate and a heater of the heaters in accordance with the measured surface temperature of the film.

Each heater may have a plate shape and may include a plurality of regions, each of the regions having a temperature, each of the temperatures being independently controllable.

Temperatures of the plurality of regions of each heater may be controlled in accordance with the measured surface temperature.

At least a part of the reflective plate may be pivotable, and a rotation angle of at least a part of the reflective plate may be controlled in accordance with the measured surface temperature.

The film drying method may further include stopping an operation of the heater when the temperature of the film reaches a target temperature.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION

Embodiments of the present invention will be described with reference to embodiments to be described along with the accompanying drawings. Embodiments of the present invention may, however, be embodied in different forms and should not be construed as limited to the embodiments set forth herein. Rather, these embodiments are provided so that this disclosure will be thorough and complete, and will fully convey the scope of the present invention to those of ordinary skill in the art. Furthermore, the present invention is defined by the scope of the claims. The terms used herein are used for describing specific embodiments and are not intended to limit embodiments of the present invention. Terms expressed in a singular form may include plural forms unless clearly otherwise referred to in context. In this application, it should be understood that the term "include," "comprise," "have", "including," "comprising,", or "having" is intended to specify that there are features, figures, steps, operations, components, parts or their combinations represented in the specification and not to exclude that there may be one or more other features, figures, steps, operations, components, parts, or their combinations or that they may be added. In addition, although terms like "a first" and "a second" are used to describe various components, the components should not be limited by the terms. The terms may be used for the purpose of distinguishing one component from another. Expressions such as "at least one of," when preceding a list of elements, modify the entire list of elements and do not modify the individual elements of the list.

Figure 1:
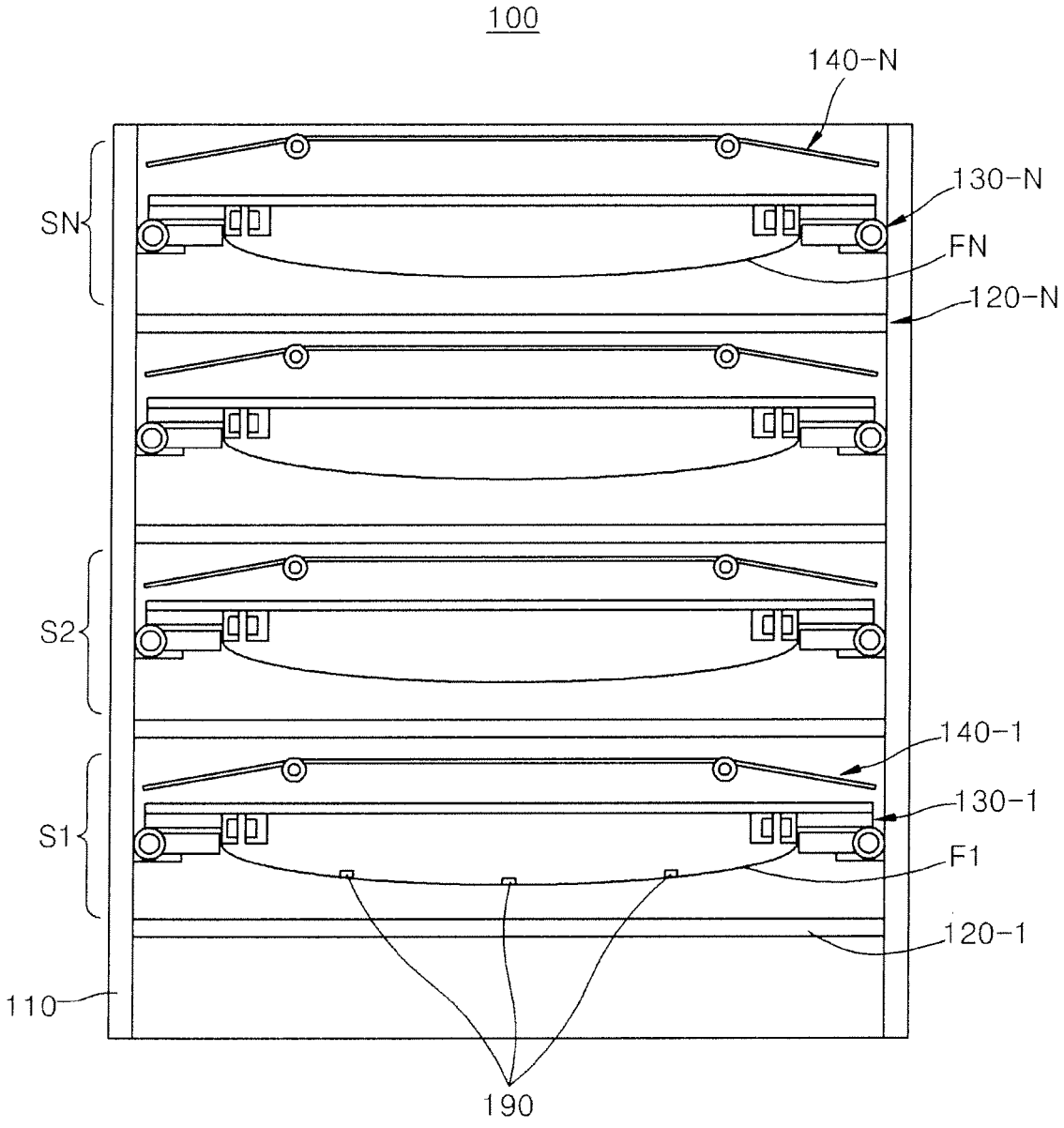
FIG. 1 is a schematic view of a film drying device according to an embodiment of the present invention.

FIG. 1 is a schematic view of a film drying device 100 according to an embodiment of the present invention.

Referring to FIG. 1, the film drying device 100 includes a chamber 110. In this case, the chamber 100 includes an internal space and the inside of the chamber 110 may selectively maintain a vacuum state.

The inside of the chamber 110 of the film drying device 100 may be partitioned into a plurality of spaces to form a plurality of slots (S1 to SN). For example, the plurality of slots may include a first slot S1 to an N-th slot SN from the lower side of the chamber 110 to an upper side thereof (where N is a natural number). In the embodiment shown, the first slot S1 corresponds to a reference slot to control the operation of the film drying device 100 and the first second slot S2 to the N-th slot SN may correspond to spaces in which a film (e.g., a real film or the apparatus to be produced) is dried.

The film drying device 100 may include a film fixing unit that fixes the film in the chamber. In addition, the film drying device 100 may include a heater that is installed in the chamber 110 and that applies energy (e.g., heat) to the film.

The film drying device 100 may include a reflective unit that is installed in the chamber 110 and that reflects energy emitted from the heater. In addition, the film drying device may include a film temperature measuring unit 190 that is installed on the film and that measures the temperature of the film. In this case, the film temperature measuring unit 190 may be installed on one of the plurality of films and may measure the temperature of each region of the film. For example, the film temperature measuring unit 190 may be arranged in the first slot S1.

The film fixing unit, the heater, and the reflective unit may be plural in number. For example, a film fixing unit, a heater, and a reflective unit may be installed in each of the first slot S1 to the N-th slot SN, or may be installed in less than all of the slots.

For example, the plurality of film fixing units may include a first film fixing unit 130-1, which is arranged in the first slot S1, to an N-th film fixing unit 130-N, which is arranged in the N-th slot SN. In this case, the film fixed to each film fixing unit may include a first film F1, which is arranged (or located) in the first slot S1, to an N-th film FN, which is arranged (or located) in the N-th slot SN.

The plurality of heaters may include a first heater 120-1, which is arranged (or located) in the first slot S1, to an N-th heater 120-N, which is arranged (or located) in the N-th slot. In addition, the plurality of reflective units may include a first reflective unit 140-1, which is arranged (or located) in the first slot S1, to an N-th reflective unit 140-N, which is arranged (or located) in the N-th slot SN.

The film drying device 100 may include a control unit that controls the first heater 120-1 to the N-th heater 120-N, and the first reflective unit 140-1 to the N-th reflective unit 140-N. In this case, the control unit may control the first heater 120-1 to the N-th heater 120-N, and the first reflective unit 140-1 to the N-th reflective unit 140-N based on the state of the first film F1 that is measured by the film temperature measuring unit 190.

The film fixing unit, the heater, and the reflective unit will be sequentially described below in more detail. In addition, for convenience of description, the first film fixing unit 130-1, the first heater 120-1, and the first reflective unit 140-1 that are arranged in the first slot S1 will be described in more detail.

Figure 2:
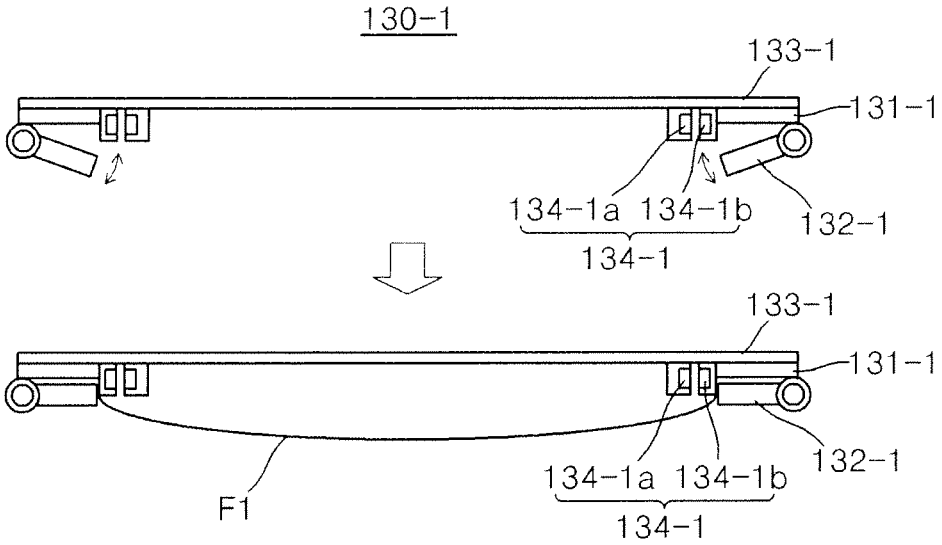
FIG. 2 is an expanded schematic view of a part corresponding to a slot of the embodiment shown in FIG. 1.
Figure 3:
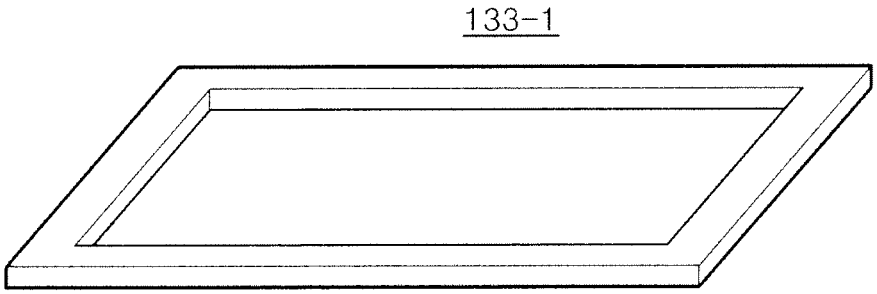
FIG. 3 is a perspective view of a first body unit of the embodiment shown in FIG. 2.

FIG. 2 is an expanded schematic view of a part corresponding to a slot S1 of FIG. 1. FIG. 3 is a perspective view of a first body unit 133-1 of FIG. 2

Referring to FIGS. 2 and 3, the first film fixing unit 130-1 may include a first clamp (or first clamp portion) 131-1 and a second clamp (or second clamp portion) 132-1 that is pivotably coupled to at least one of the chamber 110 and the first clamp 131-1. In this case, the first clamp 131-1 may be installed to be fixed to the chamber 110. In addition, the second clamp 132-1 may be selectively coupled to the first clamp 131-1 to confine (or clamp, secure, hold, or grip) the first film F1.

The first film fixing unit 130-1 may include the first body unit 133-1 that is movably placed on the first clamp 131-1. The first body unit 133-1 may be formed in a plate shape, and may have a hollow part (or window or opening) through which energy (or heat) emitted from the first heater 120-1 may pass.

In addition, the film fixing unit 130-1 may include a first tension maintaining unit 134-1 that is installed on one of the first body unit 133-1 and the first clamp 131-1. In this case, the first tension maintaining unit 134-1 may include a first magnetic unit 134-1*a*, which is installed on the first body unit 133-1, and a second magnetic unit 134-1*b*, which is installed on the first clamp 131-1. For example, the first magnetic unit 134-1*a* and the second magnetic unit 134-1*b* may be installed to face each other and may generate a repulsive force.

In this case, the first magnetic unit 134-1*a* and the second magnetic unit 134-1*b* may be formed as various types. For example, the first magnetic unit 134-1*a* and the second magnetic unit 134-1*b* may include a permanent magnet or an electromagnet. However, for the sake of convenience, an embodiment in which the first magnetic unit 134-1*a* and the second magnetic unit 134-1*b* include permanent magnets will be described below in more detail.

Figure 4:
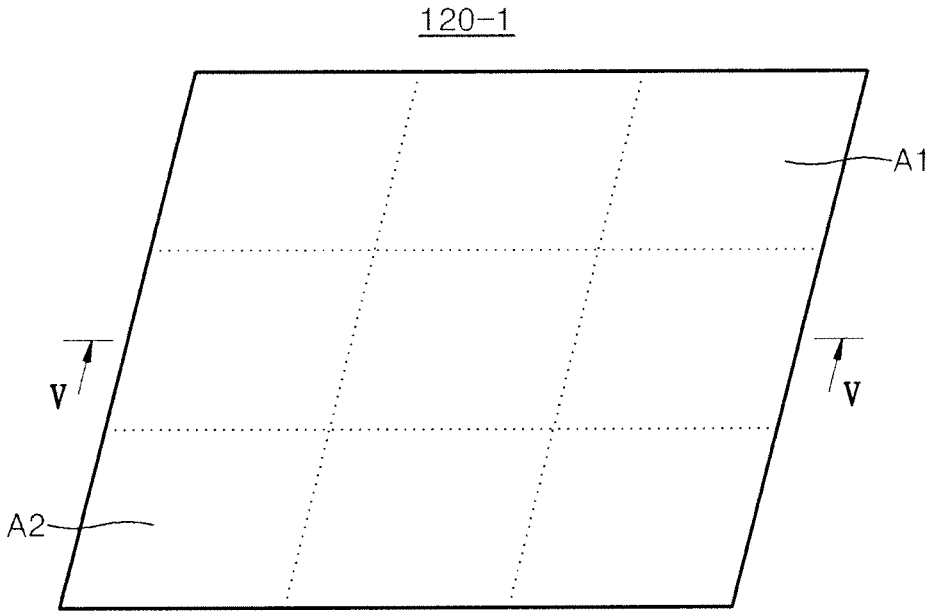
FIG. 4 is a perspective view of a first heater of the embodiment shown in FIG. 1.
Figure 5:
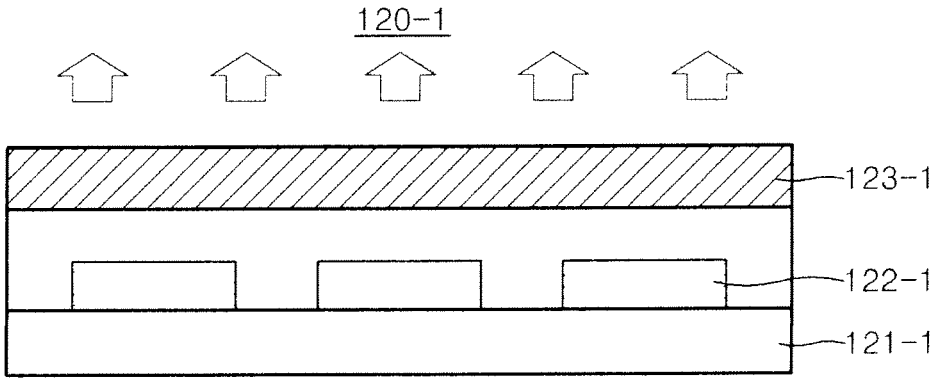
FIG. 5 is a cross-sectional view taken along a line V-V of the embodiment shown in FIG. 4.

FIG. 4 is a perspective view of the first heater 120-1 of FIG. 1. FIG. 5 is a cross-sectional view taken along a line V-V of FIG. 4.

Referring to FIGS. 4 and 5, the first heater 120-1 may be installed at the first slot S1 of the chamber 110. In this case, the first heater 120-1 may emit a far infrared ray to the outside.

For example, the first heater 120-1 may include a first plate 121-1 and a first heating wire 122-1, which is formed in the first plate 121-1. In addition, the first heater 120-1 may include a second plate 123-1, which is formed on the first plate 121-1.

In this case, the first plate 121-1 may include an aluminum material. In addition, the second plate 123-1 may include a material that generates a far infrared ray. For example, the second plate 123-1 may include a ceramic material.

Such a first heater 120-1 may be divided into a plurality of regions. In this case, the temperatures of the plurality of regions of the first heater 120-1 may be regulated (or controlled) to be different from one another. For example, the temperature of a first region A1 of the first heater 120-1 may be regulated as (or controlled to have) a first temperature, and the temperature of a second region A2 of the first heater 120-1 may be regulated as (or controlled to have) a second temperature that is different from the first temperature.

The regions of the first heater 120-1 may be set in various ways as needed. For example, the shape, number, and location of the regions of the first heater 120-1 may be formed in various ways according to a user's setting. In this case, the temperature of each region of the first heater 120-1 may be implemented to be different from one another through the first heating wire 122-1 that is distinguishably (or separately) installed on each region (e.g., each region may have its own corresponding first heating wire 122-1 that is separately controlled from other first heating wires 122-1).

Figure 6:
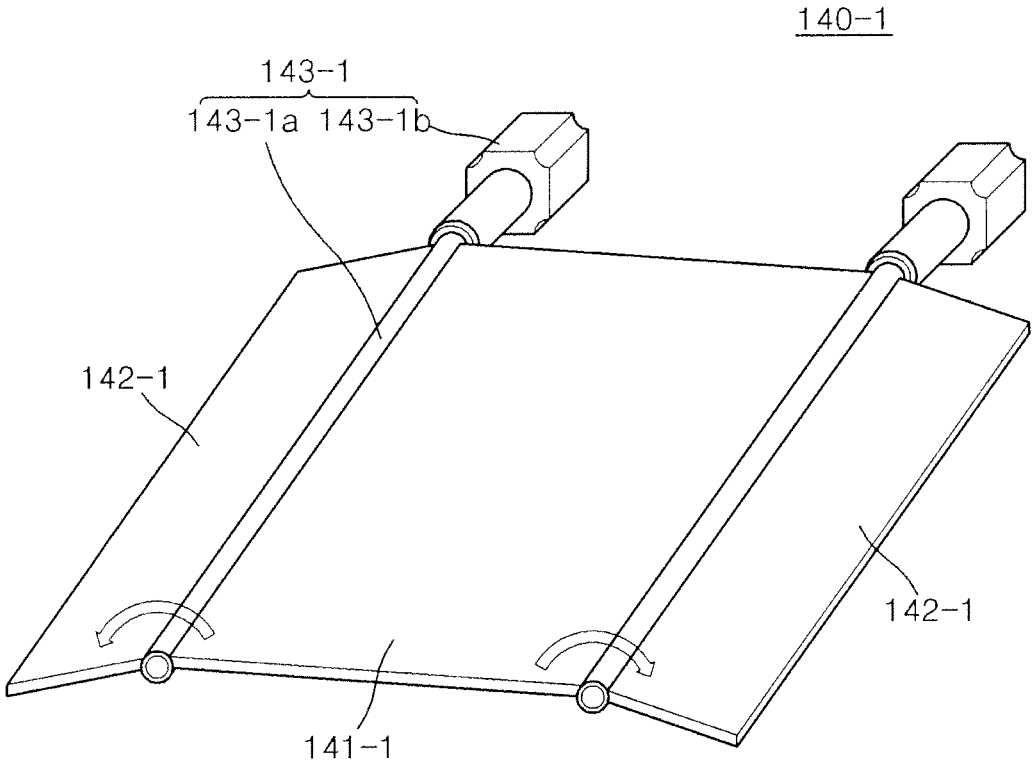
FIG. 6 is a perspective view of a first reflective unit of the embodiment shown in FIG. 1.

FIG. 6 is a perspective view of the first reflective unit 140-1 of the embodiment shown in FIG. 1. Referring to FIG. 6, the first reflective unit 140-1 may be arranged to face the first heater 120-1. In this case, the first reflective unit 140-1 may reflect energy emitted from the first heater 120-1.

The first reflective unit 140-1 includes a first reflective plate 141-1 and a second reflective plate 142-1 which is rotatably (or pivotably) connected to the first reflective plate 141-1. In the embodiment shown in FIG. 6, the second reflective plate 142-1 is plural in number and may be installed at each end of the first reflective plate 141-1.

The first reflective unit 140-1 may include a first rotation angle regulating unit 143-1 that connects the first reflective plate 141-1 to the second reflective plate 142-1. In this case, the first rotation angle regulating unit 143-1 may regulate (or control or limit) a rotation angle of the second reflective plate 142-1.

For example, the first rotation angle regulating unit 143-1 is configured to rotate and includes a first rotation shaft 143-1*b* that is connected to the second reflective plate 142-1. In addition, the first rotation angle regulating unit 143-1 includes a first driving unit 143-1*a* that is connected to and that rotates the first rotation shaft 143-1*b*.

The first driving unit 143-1*a* that is formed (or configured) in the above-described way may rotate the first rotation shaft 143-1*b* clockwise or anti-clockwise to regulate (or control) an angle made by the first reflective plate 141-*a* and the second reflective plate 142-1. In this case, the first reflective plate 141-1 may maintain its original state and only the second reflective plate 142-1 may rotate.

The operation of the film drying device 100 will be described below in more detail.

Figure 7:
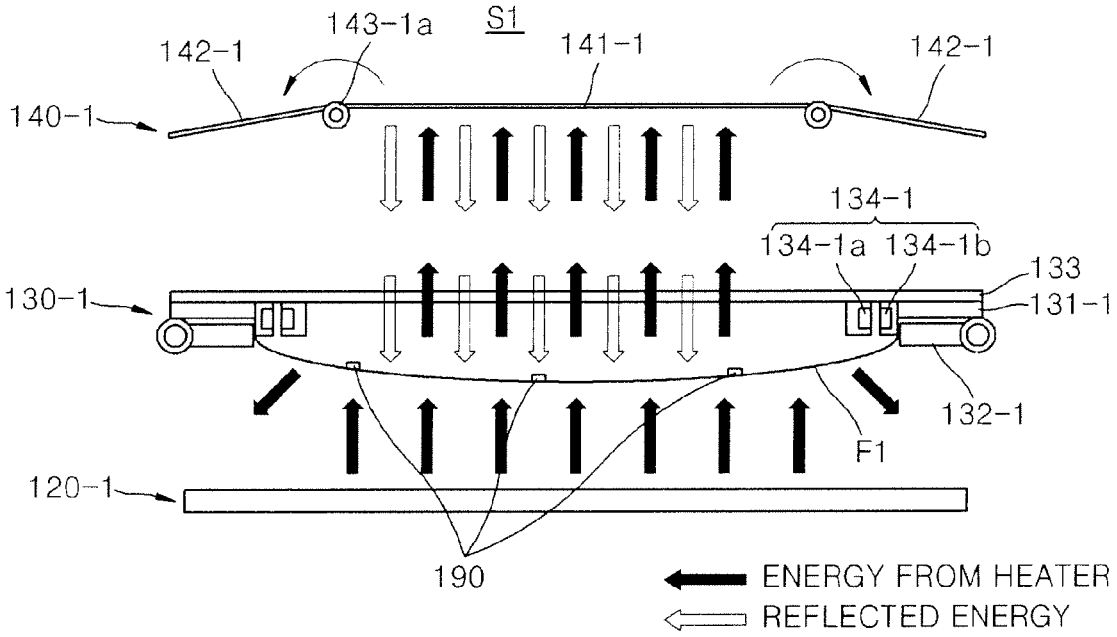
FIG. 7 is a conceptual view of an operating state of a first slot of the film drying device of the embodiment shown in FIG. 1.

FIG. 7 is a schematic view of an operating state of the first slot S1 of the film drying device 100 of FIG. 1.

Referring to FIGS. 1 and 7, it is possible to feed the first film F1 to the N-th film FN into the chamber 110 by opening the chamber 110 before the film drying device 100 starts to operate. In this case, the first film F1 to the N-th film FN may be fixed to the first fixing unit 130-1 to the N-th film fixing unit 130-N, respectively. However, because the ways of fixing the first film F1 to the N-th film FN are the same, only the way of fixing the first film F1 will be described below in more detail.

For example, in order to fix the first film F1, it is possible to rotate the second clamp 132-1 and thus obtain the gap between the first clamp 131-1 and the second clamp 132-1. In this case, one end of the first film F1 may be arranged between one first clamp 131-1 and one second clamp 132-1. In addition, the other end of the first film F1 may be arranged between the opposite first clamp 131-1 and the opposite second clamp 132-1.

When the above process is completed, it is possible to rotate the second clamp 132-1 to be in contact with the first clamp 131-1. In this case, the first clamp 131-1 and the second clamp 132-1 may be fixed by a separate fixing member. Thus, one surface of the first clamp 131-1 may be in completely close contact with the second clamp 132-1 to support (or grip) the first film F1.

When the first film F1 is fixed in this way, the central part of the first film F1 may sag due to its own weight. In this case, the first tension maintaining unit 134-1 may be used to maintain the tension of the first film F1.

For example, when the first film F1 is installed as described above, the first magnetic unit 134-1*a* and the second magnetic unit 134-1*b* may be arranged to face each other. In this case, the first magnetic unit 134-1*a* and the second magnetic unit 134-1*b* may push (e.g., repel) each other due to a repulsive force as described above. For example, a force may be applied to the central part of the first body unit 133-1 due to the repulsive force applied to the first magnetic unit 134-1*a* by the second magnetic unit 134-1*b*, and a force may be applied to the perimeter of the first body unit 133-1 due to the repulsive force applied to the second magnetic unit 134-1*b* by the first magnetic unit 134-1*a*. Thus, because the interval (or space or distance) between the first clamps 131-1 that fix both (e.g., opposite) ends of the first film F1 grows due to the force having opposite directions, it is possible to maintain the tension of the first film F1.

When the first film F1 is fixed as described above, it is possible to operate the first heater 120-1. In this case, when the first heater 120-1 operates, it is also possible to simultaneously operate the first heater to the N-th heater 120-N.

In addition, when the first heater 120-1 to the N-th heater 120-N operate, the first reflective unit 140-1 to the N-th reflective unit 140-N may operate. In this case, because the operations of the first reflective unit 140-1 to the N-th reflective unit 140-N are similar to one another, only the operation of the first reflective unit 140-1 will be described. That is, the first rotation angle regulating unit 143-1 may operate to rotate the second reflective plate 142-1. For example, the control unit may control the first rotation angle regulating unit 143-1 so that the second reflective plate 142-1 rotates at a rotation angle (e.g., a preset rotation angle).

In this case, the central part of each film may generally become closer to each heater due to self-weight (or its own weight) when each film is fixed to each film fixing unit. Thus, because energy emitted from each heater may be uniform, more radiant heat may be applied from each heater to the central part of each film.

In the above case, energy emitted from each heater may penetrate each film and be transmitted to each reflective unit, and may be reflected from each reflective unit back toward each film. In a case where the first reflective plate 141-1 and the second reflective plate 142-1 of each reflective unit form a plane, all (or substantially all or most of) the energy that is reflected is directed substantially uniformly toward each portion of the film.

For example, in the above case, the sum of the energy emitted from each heater and the energy reflected from each reflective unit may be greatest at the central part of each film and may be smallest at the edge parts of each film. In this case, because energy is not uniformly transmitted to the surface of each film, there may be a limitation (or defect) in that, after drying, the surface of the film is uneven. Thus, by rotating the second reflective plate 142-1 with respect to the first reflective plate 141-1, it is possible to decrease the gap (e.g., the distance) between the second reflective plate 142-1 and the film and thus increase the energy (or heat) reflected by the second reflective plate 142-1. Thus, it is possible to uniformly generate energies that reach each film (e.g., supply heat substantially uniformly across each of the films).

When the operations of the first reflective unit 140-1 to the N-th reflective unit 140-N are completed as described above, the first heater 120-1 to the N-th heater 120-N operate as described above and it is thus possible to dry the first film F1 to the N-th film FN. In this case, each of the first heater 120-1 to the N-th heater 120-N are divided into the plurality of regions as described above, and the control unit may individually control the temperature of each region of the first heater 120-1 to the temperature of each region of the N-th heater 120-N. For example, the control unit may control each of the first heater 120-1 to the N-th heater 120-N so that the temperature of each region of the first heater 120-1 to the temperature of each region of the N-th heater 120-N correspond to temperatures (e.g., preset temperatures).

While the first film F1 to the N-th film FN are being dried, the control unit may receive feedback regarding the surface temperature of the first film F1 that is measured from the film temperature measuring unit 190. In this case, the control unit may determine whether the measured surface temperature of the first film F1 is the same as a target temperature (e.g., a preset target temperature).

For example, when it is determined that the measured surface temperature of the first film F1 is not the same as the target temperature, the control unit may control the operation of at least one of the first heater 120-1 to the N-th heater 120-N and the first reflective unit 140-1 to the N-th reflective unit 140-N.

For example, when it is determined that the measured surface temperature of the first film F1 is not the same as the target temperature, the control unit may control the operation of at least one of the first heater 120-1 and the first reflective unit 140-1. In a case where the control unit controls the operation of the first heater 120-1, the control unit may control the second heater 120-2 to the N-th heater 120-N so that their operations are the same as that of the first heater 120-1.

For example, when it is determined that the surface temperature of the first film F1 is lower than a target temperature (e.g., a preset target temperature), the control unit may increase energy that is emitted from the first heater 120-1 to the N-th heater 120-N. On the contrary, when it is determined that the surface temperature of the first film F1 is higher than the target temperature, the control unit may stop the operations of the first heater 120-1 to the N-th heater 120-N.

In this embodiment, the target temperature may be set to correspond to each region of the first film F1. For example, the control unit may compare the surface temperature of each region of the first film F1 with the target temperature of each region and then control energy that is emitted from each region of the first heater 120-1 to the N-th heater 120-N. For example, when the surface temperature of each region of the first film F1 is lower than the target temperature of each region, the control unit may control the first heater 120-1 to the N-th heater 120-N to increase energy that is emitted from a corresponding part of the first heater 120-1 to a corresponding part of the N-th heater 120-N. On the contrary, when the surface temperature of each region of the first film F1 is higher than the target temperature of each region, the control unit may control the first heater 120-1 to the N-th heater 120-N to stop the operations of a corresponding part of the first heater 120-1 to a corresponding part of the N-th heater 120-N. Thus, energy that is emitted from the first heater 120-1 to the N-th heater 120-N is controlled by region and it is thus possible to uniformly transmit energy to the surface of each film.

In addition, in an embodiment where the control unit controls the operation of the first reflective unit 140-1, the control unit may control a second reflective unit to the N-th reflective unit 140-N so that their operations are the same as that of the first reflective unit 140-1. For example, when the first film F1 has a region where the surface temperature of the first film F1 is lower than a target temperature (e.g., a preset target temperature), the control unit may control the operation of the first driving unit 143-1*a* to rotate the second reflective plate 142-1 and thus focus reflected energy on the region of the first film F1 where the surface temperature of the first film F1 is lower than the target temperature. In addition, when the first film F1 has a region where the surface temperature of the first film F1 is higher than a target temperature (e.g., a preset target temperature), the control unit may control the first driving unit 143-1*a* to rotate the second reflective plate 142-1 in order to prevent reflected energy from becoming focused on (e.g., redirect reflected energy away from) the region of the first film F1 where the surface temperature of the first film F1 is higher than the target temperature. In this case, the control unit may also control the second reflective unit to the N-th reflective unit 140-N so that they operate in the above-described way.

In addition, in an embodiment where the control unit controls the first heater 120-1 and the first reflective unit 140-1, the control unit may also control the operations of the second heater to the N-th heater 120-N and the second reflective unit to the N-th reflective unit 140-N so that their operations are the same as those of the heater 120-1 and the first reflective unit 140-1. In this case, the ways of controlling the first heater 120-1 to the N-th heater 120-N by the control unit or the ways of controlling the first reflective unit 140-1 to the N-th reflective unit 140-N by the control unit are substantially the same as those described above, and their detailed descriptions will thus not be repeated here.

The above processes may be repetitively performed while each film is dried. When a time (e.g., a preset time) passes after the processes are successively repeated through such feedback, the control unit may stop the operations of the first heater 120-1 to the N-th heater 120-N. In this case, the control unit may change the inner space of the chamber 110 from a vacuum state to an atmospheric-pressure state.

For example, when the inner space of the chamber 110 becomes the atmospheric-pressure state, a user may open the chamber 110 and then remove each film from the chamber 110. The film is removed in a manner that is the reverse of the sequences described above, and thus a related detailed description will not be provided here.

Thus, according to the film drying device 100 and the film drying method, it is possible to insert and dry a plurality of films in the chamber 110 and thus decrease a necessary working time and increase working efficiency. In addition, the film drying device 100 and the film drying method may receive feedback regarding the state of the first film F1 installed in the first slot S1, regulate drying environments of the second slot S2 to the N-th slot SN, and thus control drying environments precisely and accurately.

Although the present invention has been described in relation to the above exemplary embodiments, it is possible to make various variations or modifications without departing from the subject matter or scope of the present invention. Thus, the following claims will include such modifications or variations that belong to the subject matter of the present invention and equivalents thereof.

What is claimed is:

1. A film drying device comprising:

a chamber;

a film fixing unit in the chamber and configured to hold an edge of a film except a central portion of the film; and a heater in the chamber and configured to apply heat to the film.

2. The film drying device of claim 1, wherein the chamber is configured to selectively maintain a vacuum state.

3. The film drying device of claim 1, wherein the film fixing unit comprises:

a first clamp; and a second clamp pivotably connected to at least one of the chamber and the first clamp, wherein the second clamp is configured to be selectively coupled to the first clamp to confine the film.

4. The film drying device of claim 3, wherein the film fixing unit further comprises a body unit mounted movably on the first clamp.

5. The film drying device of claim 4, wherein the body unit has an opening.

6. The film drying device of claim 4, wherein the film fixing unit further comprises a tension maintaining unit on at least one of the body unit and the first clamp.

7. The film drying device of claim 6, wherein the tension maintaining unit comprises:

a first magnetic unit on the body unit; and a second magnetic unit on the first clamp and configured to generate a repulsive force oriented to repel the first magnetic unit.

8. The film drying device of claim 1, wherein the heater is configured to emit a far infrared ray.

9. The film drying device of claim 1, wherein the heater comprises:

a first plate;

a heating wire in the first plate; and a second plate on the first plate.

10. The film drying device of claim 9, wherein the first plate comprises aluminum.

11. The film drying device of claim 9, wherein the second plate is configured to emit a far infrared ray.

12. The film drying device of claim 9, wherein the second plate comprises a ceramic material.

13. The film drying device of claim 1, wherein the heater comprises a plurality of regions, and wherein the temperatures of each of the plurality of regions of the heater are configured to be controlled independently of one another.

14. The film drying device of claim 1, further comprising a plurality of heaters and a plurality of the film fixing units, and wherein the heaters and the film fixing units are alternately arranged.

15. The film drying device of claim 14, further comprising a film temperature measuring unit on the film on one of the plurality of film fixing units, the film temperature measuring unit being configured to measure a temperature of the film.

16. The film drying device of claim 15, wherein an operation of at least one of the plurality of heaters is regulated in accordance with the temperature of the film measured by the film temperature measuring unit.

17. The film drying device of claim 1, further comprising a reflective unit configured to reflect the heat emitted from the heater.

18. The film drying device of claim 17, wherein the reflective unit comprises:

a first reflective plate; and a second reflective plate pivotably connected to the first reflective plate.

19. The film drying device of claim 18, wherein the reflective unit further comprises a rotation angle regulating unit coupling the reflective plate to the second reflective plate and configured to control an angle between the second reflective plate and the first reflective plate.

20. A film drying method comprising:

feeding a plurality of films into a vacuum chamber and then operating each of a plurality of heaters at a temperature;

measuring a surface temperature of a film using a film temperature measuring unit coupled to one of the plurality of films; and controlling an operation of at least one of a reflective plate and a heater of the heaters in accordance with the measured surface temperature of the film.

21. The film drying method of claim 20, wherein each heater has a plate shape and comprises a plurality of regions, each of the regions having a temperature, each of the temperatures being independently controllable.

22. The film drying method of claim 21, wherein temperatures of the plurality of regions of each heater are controlled in accordance with the measured surface temperature.

23. The film drying method of claim 22, wherein at least a part of the reflective plate is pivotable, and wherein a rotation angle of at least a part of the reflective plate is controlled in accordance with the measured surface temperature.

24. The film drying method of claim 20, further comprising stopping an operation of the heater when the temperature of the film reaches a target temperature.

* * * * *